US006688315B1

(12) United States Patent
Harrison

(10) Patent No.: US 6,688,315 B1
(45) Date of Patent: Feb. 10, 2004

(54) HAIR EXTENSION SYSTEM AND METHOD

(75) Inventor: Dawn P. Harrison, Vista, CA (US)

(73) Assignee: Hair Addition Studio, Inc., Vista, CA (US)

( * ) Notice: Subject to any disclaimer, the term of this patent is extended or adjusted under 35 U.S.C. 154(b) by 0 days.

(21) Appl. No.: 09/990,406

(22) Filed: Nov. 21, 2001

(51) Int. Cl.[7] ..... A41G 3/00; A41G 5/00
(52) U.S. Cl. ..... 132/201; 132/53
(58) Field of Search ..... 132/201, 53, 54, 132/56, 55

(56) References Cited

U.S. PATENT DOCUMENTS

| | | | | | |
|---|---|---|---|---|---|
| 3,447,541 | A | * | 6/1969 | Golden | 132/201 |
| 3,710,452 | A | * | 1/1973 | Hamrick | 132/201 |
| 4,456,019 | A | * | 6/1984 | Finamore | 132/53 |
| 4,509,539 | A | * | 4/1985 | Alfieri | 132/53 |
| 4,600,029 | A | * | 7/1986 | Ueberschaar | 132/53 |
| 4,784,713 | A | | 11/1988 | Van Nieulande | |
| 5,107,867 | A | | 4/1992 | Barrington | |
| 5,218,977 | A | * | 6/1993 | Takahashi | 132/54 |
| 5,592,957 | A | * | 1/1997 | Gazerro et al. | 132/53 |
| 5,855,211 | A | * | 1/1999 | Nelson | 132/53 |
| 5,868,145 | A | | 2/1999 | Spann | |
| 5,894,846 | A | | 4/1999 | Gang | |
| 5,899,209 | A | | 5/1999 | McDonald et al. | |
| 6,012,460 | A | * | 1/2000 | Kikuchi | 132/53 |
| 6,016,814 | A | * | 1/2000 | Elliott | 132/201 |
| 6,035,861 | A | | 3/2000 | Copello | |
| 6,267,118 | B1 | * | 7/2001 | Ito et al. | 132/201 |

* cited by examiner

*Primary Examiner*—Kevin Shaver
*Assistant Examiner*—Stephanie Willatt
(74) *Attorney, Agent, or Firm*—Colleen McKiernan

(57) ABSTRACT

A hair extension device has a skin-simulating layer of artificial skin material having an inner face for attachment to a wearer's scalp and an outer face. The skin-simulating layer has an opening through which a portion of a wearer's existing hair can be pulled. A plurality of hair strands are secured to the skin simulating layer around the opening to extend from the outer face of the layer in order to imitate naturally growing hair when integrated with the natural hair pulled through the opening.

2 Claims, 2 Drawing Sheets

HAIR EXTENSION SYSTEM AND METHOD

BACKGROUND OF THE INVENTION

The present invention relates to a hair extension system and method for attaching such a system to a wearer's head.

In my co-pending application Ser. No. 09/836,918 filed Apr. 18, 2001, a hair integration system for extending over the entire head is described. However, in some cases, it is desired to add a lesser amount of hair to the head, and smaller hair extensions are often used for this purpose.

Hair extensions of natural or artificial hair are often used in the hairdressing field in order to provide the appearance of longer or thicker hair. Such extensions are used for cosmetic reasons, in order to enhance the appearance of natural hair or change its look, or in order to supplement thinning hair. Some hair extension methods involve adhering bunches of extension hair to a person's natural hair, which is an expensive and time consuming process. A method of this type is described, for example, in U.S. Pat. No. 5,107,867 of Barrington. In U.S. Pat. No. 5,894,846 of Gang, a method for lengthening and thickening hair is described. In this method, a knotted strand of the persons own hair is disposed in one end of a tube. An extension piece of hair extends from the other end of the tube. This process is repeated over the person's head. Again, the process is extremely time consuming, typically taking several hours to complete.

One problem with attaching hair extensions by adhering to the person's own hair is that the hair extensions will grow out as the natural hair grows. Also, significant shedding of supplemental hair tends to occur as a result of brushing, washing, or other normal hair grooming activities. This is frustrating for the client who has invested a significant amount of time and money in the hair extension process.

SUMMARY OF THE INVENTION

It is an object of the present invention to provide a new and improved hair extension system and method.

According to one aspect of the present invention, a hair extension system is provided, which comprises a skin-simulating layer having an inner face for attachment to a wearer's scalp and an outer face, the skin-simulating layer having an opening for pulling a portion of a wearer's existing hair through the opening, and a plurality of hair strands secured to the skin simulating layer around the opening to extend from the outer face of the layer in order to imitate naturally growing hair.

In an exemplary embodiment of the invention, the skin-simulating layer is of a stretchable material having a curvature for substantially matching the curvature of the wearer's scalp, so that it can adhere in close, face-to-face engagement with the scalp. The layer may comprise two arcuate strips or bands which are connected together at their outer ends, with the opening being generally crescent-shaped. The layer may be formed integrally in one piece from a single sheet of material having a curvature and with a suitable crescent-shaped cut-out to form the hair pull-through opening.

The skin-simulating material may be a product of the type generally known as artificial or man-made skin, which is normally a polyurethane material of a skin-tone color, and is stretchable to be more readily conformed and adhered to a wearer's scalp. It may be adhered to the scalp by a suitable grafting agent or adhesive.

According to another aspect of the present invention, a hair extension method is provided, which comprises the steps of:

parting a wearer's hair to form a central bunch of hair with first and second part lines following a generally crescent-shaped path;

tying the bunch of hair together in a pony tail;

applying a layer of adhesive to an inner face of a skin-simulating layer of a hair extension device having hair attached around the outer face of the skin-simulating layer, the skin-simulating layer having upper and lower generally arcuate strips joined together at their outer ends and defining a generally crescent-shaped opening between the strips;

pulling the pony tail through the opening in the hair extension device with the inner face facing towards the wearer's scalp;

pressing the inner face of the skin-simulating layer along the part lines of the wearer's scalp around the opening to adhere the hair extension device to the scalp; and releasing the wearer's hair from the pony tail and integrating the hair extending through the opening with the hair attached to the layer surrounding the opening.

This arrangement allows a hair extension device to be adhered directly to the wearer's scalp, so that it does not grow out as the hair grows. The arrangement of a hair extension device with an opening through which the wearer's own hair extends allows the natural hair to be integrated with the hair on the extension device for a more natural look.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 1:
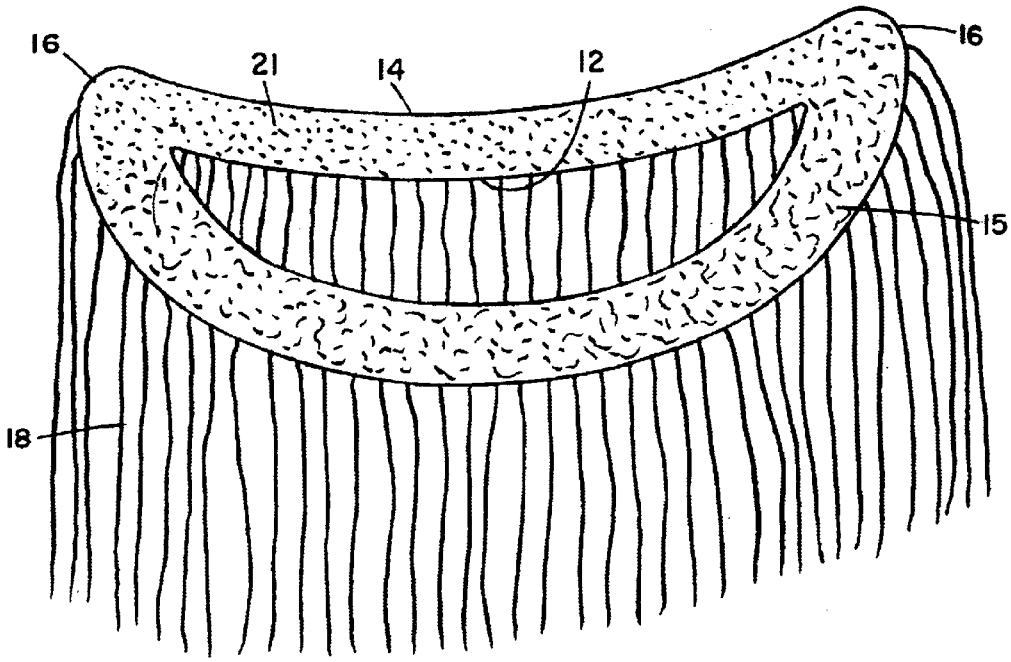
FIG. 1 is a perspective view, from the inside of the hair extension device according to an exemplary embodiment of the invention.
Figure 2:
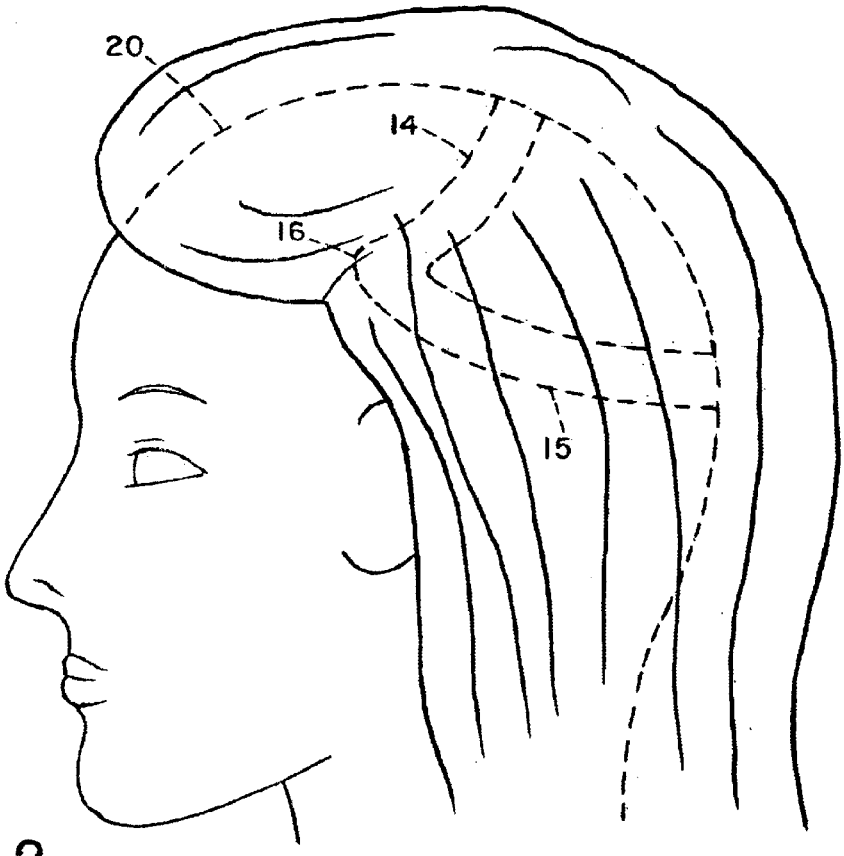
FIG. 2 is a side view of a head showing the extension fitted under and incorporated into the hair.

The drawings illustrate a hair extension system and method according to an exemplary embodiment of the present invention. A hair extension device 10 comprises a layer of skin-simulating material having a central, generally crescent-shaped opening 12 defining an upper strip 14 and a lower strip 15 of the material which are joined together at their outer ends or corners 16. The skin layer has an outer face 17 from which hair strands 18 project so as to substantially cover the entire outer surface of the device. The strands 18 extend outwardly from the device so as to imitate naturally growing hair. The hair strands may be of any desired color or blend of colors, depending on the wearer's own natural hair color. Normally, at least two to three separate hair colors are blended to produce the desired natural effect.

The upper band or strip 14 may be narrower than the lower strip 15 so that more hair is added at the back of the head. In an exemplary embodiment, the upper strip had a width of around ¾" , while the lower strip width was 1" .

This provides medium hair density at the crown and temples of the head, and medium heavy hair density at the nape, when the extension is installed. The hair used in the extension system may be natural or artificial, and in the exemplary embodiment a type of human hair known in the hairdressing field as "Remi" hair was used.

The skin layer is suitably formed in one piece from a stretchable, skin simulating polyurethane material which is skin-toned. The material is molded to form a relatively thin layer which is curved to follow the natural curvature of the scalp, before cutting out the central, generally crescent-shaped opening 12. Thus, rather than using a flat sheet of material and cutting it out to the illustrated shape, a curved sheet is used to form the device 10. This will more naturally follow the contours of a wearer's head when attached to the scalp, so there is a better, closer bond to the scalp and less risk of the device becoming loose. The hair strands have ends which are actually embedded in the polyurethane material of the skin layer while it is curing, providing a much stronger bond and reducing the risk of premature shedding. The ends are formed into a V-shape before embedding into the polyurethane while it is still molten, and the material is then allowed to cure while the hair ends are in place. This produces a natural appearance and flow to the hair. The hair can be parted or brushed to one side, since the V-root technique will allow each hair to pivot through 360°.

Figure 3:
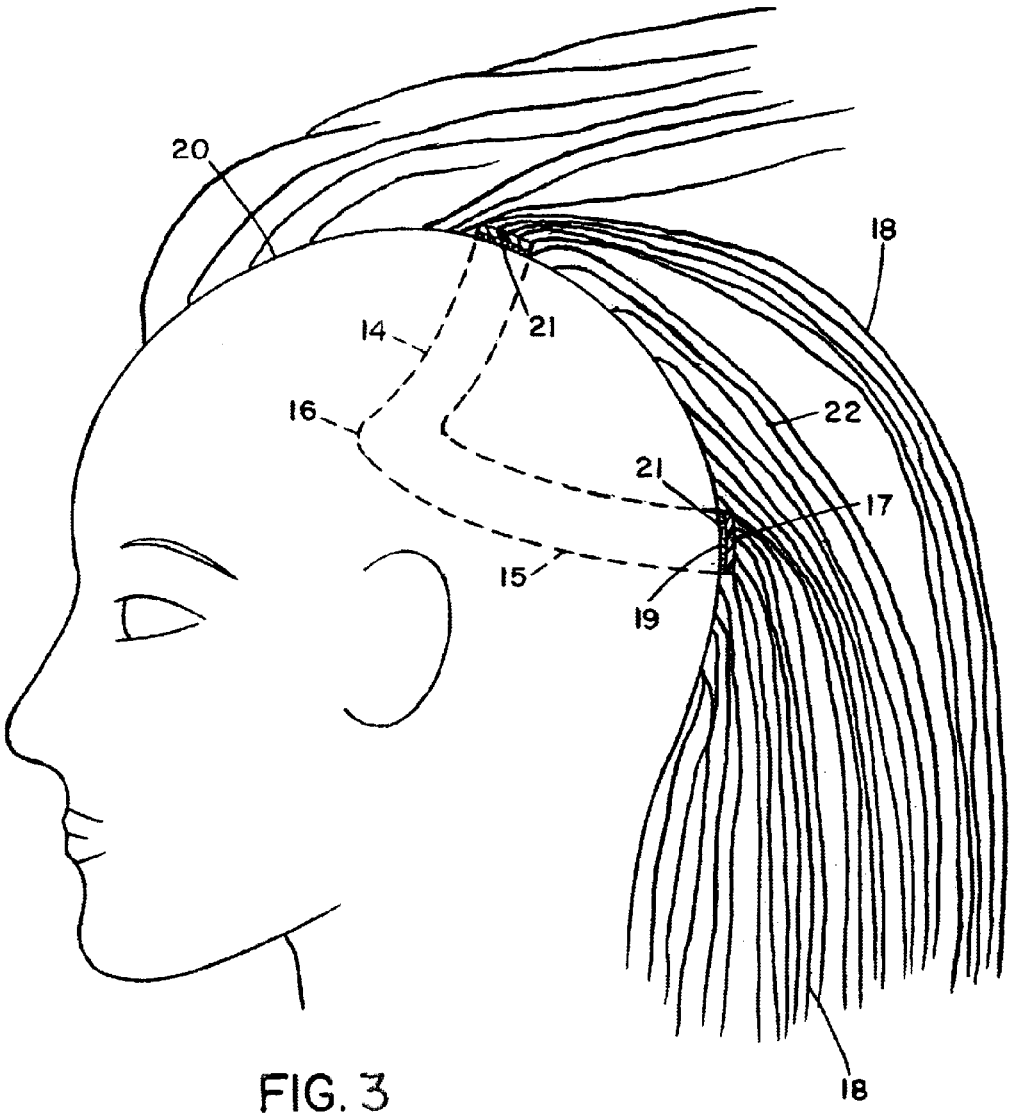
FIG. 3 is a side view with the hair cut away to show the attachment of the hair extension.

The inner face 19 of the skin-simulating layer is designed to be bonded or adhered to the wearer's scalp 20 with a layer of adhesive or grafting solution 21, as best indicated in FIG. 3. Prior to application to the scalp, the wearer's hair is parted along two spaced lines corresponding generally to the stretched shape of the opening 12, and the hair is separated along the part lines. The portion or bunch 22 of hair contained within the part lines is secured together in a pony tail by a suitable band or pony tail holder, and the other hair is clipped out of the way. Grafting solution is applied to the scalp along the part lines, and to the entire inner face of the skin-simulating layer. The bunch 22 of hair is then pulled through the opening 12, and the two strips 14,15 of the extension device are pressed down along the part lines to bond to the wearer's scalp. Once the device is bonded or grafted to the wearer's scalp 21, the pony tail holder is removed and the wearer's hair protruding through the opening 12 is integrated with the hair 18 extending from the extension device.

The extension device may be trimmed readily around its periphery if desired, for example if a customer has a smaller head or if they want less added weight on their head. For example, the hairdresser may cut across the outer ends to shorten them, or even separate the upper band from the lower band. In this case, each band will be adhered separately to the scalp. Alternatively, or additionally, the outer edge of each band may be trimmed. The artificial skin is relatively thin and easily cut to any desired size.

The curvature and peripheral shape of the skin-simulating layer of the hair extension device is such that it can be bonded closely in face-to-face engagement with the scalp. The extension hair follows the natural growing direction of hair from the wearer's scalp and can be more readily integrated with the wearer's remaining hair, as can be seen in FIG. 3. Since the bands or strips forming the skin layer follow the natural curvature of the head, they can be adhered more closely to the scalp, with less risk of separation. The hair extension device can be worn for six to eight weeks without requiring re-attachment, which is significantly longer than for existing hair extension devices and techniques.

This hair extension system is particularly suitable for individuals with fine or relatively thin hair, unlike previous extensions which typically worked best with relatively thick, dense hair in order to camouflage the attachment. Since the hair extension device of this invention has a base which bonds in a thin, flexible layer directly to the wearer's scalp, it will not be visible to the eye, even for user's with relatively thin or fine hair, and will actually remain securely attached to the scalp for a longer period of time when the wearer has thin hair, since there will be less grow out. The stretchable artificial skin contours easily to the curvature of the wearer's head, ensuring a more or less perfect fit. Since it has no seams or bumps, it is very comfortable to wear and can be slept in without problem. It is undetectable to the touch or to the eye, even on running the fingers through the hair or combing or brushing the hair.

Although an exemplary embodiment of the invention has been described above by way of example only, it will be understood by those skilled in the field that modifications may be made to the disclosed embodiment without departing from the scope of the invention, which is defined by the appended claims.

I claim:

1. A hair extension method, comprising the steps of:

parting a wearer's hair to form a central bunch of hair with first and second part lines following a generally crescent-shaped path;

tying the bunch of hair together in a pony tail;

applying a layer of adhesive to an inner face of a skin-simulating layer of a hair extension device, the device having hair attached strands extending from the outer face of the skin-simulating layer, the skin-simulating layer having upper and lower generally arcuate strips joined together at their outer ends and defining a generally crescent-shaped opening between the strips;

pulling the pony tail through the opening in the hair extension device with the inner face facing towards the wearer's scalp;

pressing the inner face of the skin-simulating layer along the part lines of the wearer's scalp around the opening to adhere the hair extension device to the scalp; and releasing the wearer's hair from the pony tail and integrating the hair extending through the opening with the hair attached to the layer surrounding the opening.

2. The method as claimed in claim 1, wherein the upper strip is adhered to the wearer's scalp so as to extend between the temples and across the crown of the head, and the lower strip is adhered across the nape of the head at a location spaced above the rear hair line.

* * * * *